US005398772A

United States Patent [19]

Edlund

[11] Patent Number: 5,398,772

[45] Date of Patent: Mar. 21, 1995

[54] IMPACT HAMMER

[75] Inventor: Hans E. Edlund, Roanoke, Va.

[73] Assignee: Reedrill, Inc., Denison, Tex.

[21] Appl. No.: 86,525

[22] Filed: Jul. 1, 1993

[51] Int. Cl.[6] ..... E21C 3/06; E21B 1/02

[52] U.S. Cl. ..... 173/206; 173/210; 92/209

[58] Field of Search ..... 173/206, 210; 92/209, 92/208, 233

[56] References Cited

U.S. PATENT DOCUMENTS

| | | | |
|---|---|---|---|
| 1,866,819 | 7/1932 | Renfer | 173/206 |
| 2,598,455 | 5/1952 | Smith . | |
| 2,694,383 | 11/1954 | Larcen | 173/206 X |
| 2,765,776 | 10/1956 | Pyk . | |
| 2,919,678 | 1/1960 | Sublett et al. . | |
| 3,035,548 | 5/1962 | Wittlich . | |
| 3,661,216 | 5/1972 | Yamanaka . | |
| 3,760,887 | 9/1973 | Palauro . | |
| 3,952,819 | 4/1976 | Adcock . | |
| 4,179,983 | 12/1979 | Wallace . | |
| 4,196,655 | 4/1980 | LeBlanc et al. . | |
| 4,408,668 | 10/1983 | Kühn et al. . | |
| 4,653,596 | 3/1987 | Kostylev et al. . | |
| 4,690,226 | 9/1987 | Schnizler et al. . | |
| 4,819,739 | 4/1989 | Fuller . | |
| 4,821,813 | 4/1989 | Jenne et al. . | |
| 4,852,664 | 8/1989 | Terada et al. . | |
| 4,872,516 | 10/1989 | MacFarlane et al. . | |
| 4,923,018 | 5/1990 | Meek . | |
| 4,945,998 | 8/1990 | Yamanaka . | |
| 4,993,504 | 2/1991 | Rodert et al. . | |
| 5,056,606 | 10/1991 | Barthomeuf . | |
| 5,064,005 | 11/1991 | Krone . | |
| 5,065,823 | 11/1991 | Gien et al. . | |
| 5,088,566 | 2/1992 | Gustafsson et al. | 173/206 X |
| 5,129,466 | 7/1992 | Bartels et al. | 173/206 X |
| 5,134,989 | 8/1992 | Akahane . | |

*Primary Examiner*—Rinaldi I. Rada
*Attorney, Agent, or Firm*—David H. Judson

[57] ABSTRACT

In an impact drilling apparatus, an impact hammer is provided that includes a body portion and a piston head on the body portion. The piston head has a larger outer periphery than the body portion. The body portion and the piston head have substantially the same cross-sectional area at all points along a longitudinal axis of the hammer. The piston head is disposed at one end of the body portion and is funnel-shaped.

18 Claims, 6 Drawing Sheets

IMPACT HAMMER

FIELD OF THE INVENTION

The present invention relates to hammers for impact devices. More particularly, the present invention relates to hammers for large bore pneumatic rock drills.

BACKGROUND AND SUMMARY OF THE INVENTION

Pneumatic rock drills generally include a housing, in which is formed a cylindrical chamber, and a reciprocating hammer is mounted in the chamber. An anvil or shank at one end of the chamber is positioned to be struck by the hammer. Pressurized air is supplied to the cylinder alternately on opposite sides of the hammer to cause the hammer to reciprocate in the cylinder and to repeatedly strike the shank.

In some applications, several drill rods may be connected in a string between the hammer and a drill bit to reach the bottom of a hole being drilled. The rods are joined axially and the impact from the hammer is transmitted along the string of rods to the drill bit. This arrangement is typically used in drilling blast holes in rock, which requires holes that are relatively long and narrow.

For reasons related to safety, the handling characteristics of the drill apparatus, and the cost of air compressors, pneumatic drills generally use relatively low pressure air, typically in the range of 60 to 100 p.s.i. In order to generate the forces necessary for rock drilling from relatively low pressure air, pneumatic drills of the prior art have typically been provided with large chamber bores and large diameter hammer piston heads. Typical of this type of drill are the Gardner-Denver PR1000, PR66, and PR80 Drills. In these drills, a drill hammer has a substantially larger cross-sectional diameter at the hammer piston head than does the remainder of the length of the hammer and the impact face of the hammer. The large cross-section piston head has a large surface area against which relatively low pressure air acts to develop forces to accelerate the hammer.

Kinetic energy from movement of the hammer is transformed into impact energy when the hammer strikes the shank and an incident wave form resulting from particle motion in the hammer is generated. At each interface between components of the drill string, such as at the interface between the hammer and the shank, the shank and any drill rods, the drill rods or the shank and a drill bit, and the drill bit and the rock being drilled, the incident wave form gives rise to transmitted and reflected wave form components, which propagate back and forth in the drill string. The drill bit is pushed into the rock when the leading compressive part of the original incident wave form reaches the drill bit.

The length and shape of the incident wave form is a function of drill string geometry; particularly, the length and diameter of a drill hammer, a shank, drill rods in a string, and a drill bit. The amplitude of the stress component of the incident wave form is largely a function of impact velocity.

Conventional pneumatic hammer configurations present problems in the efficient formation of kinetic energy of the moving hammer into impact energy in the stationary shank, and in the efficient transfer of impact energy along the drill string to the drill bit. The reflected wave form component generated at each interface is a function of the impedance or dynamic stiffness at the interface. A portion of the compressive tail of the reflected wave comprises rebound losses back into the preceding impacting member. The rebound portion of the reflected wave form is larger with a stiff response, but could be equal to zero for a free end reflection.

Although the reflected waves may themselves be reflected in the rods, and may eventually reach the drill bit, reflected energy generally performs little work on the rock and may be considered lost. Energy is lost, for example, to friction in the drill string couplings as a stress wave passes through them. The energy transfer from the first rod to the coupling, and from the coupling to the next rod in the string causes unbalanced tensile and compressive forces in the coupling. The unbalanced forces result in movement between the couplings and the rods which give rise to friction losses. A significant amount of these energy losses may be attributed to reflected energy. Thus, to achieve efficient transfer of the energy of impact to a drill bit, it is desirable to minimize reflected energy.

The reflected energy in hammer drills can be a significant portion of the total energy generated during the impact. As is explained by B. Lundberg, *Some Basic Problems in Percussive Rock Destruction,* 214–15 (1971), the reflected wave component is minimized in drilling apparatus in which the impedance or dynamic stiffness between the hammer, successive drilling apparatus components, and the rock being drilled are equal. In impact devices in which the hammer, the shanks, the drill rods, and the drill bit are formed of the same or similar materials (i.e., the material densities and wave velocity through the materials are substantially the same) the reflected wave component is minimized when the cross-sectional areas of the hammer and the shanks taken through planes at any point on a longitudinal axis through the hammer or rods are equal.

The theoretical stress wave of a conventional hammer configuration is illustrated in FIGS. 1A, 1B, and 1C by wave forms X′, X″ and X‴. The stress amplitude a of the first stress component of the wave form is related to the hammer geometry, as shown by the equation:

$$\sigma = \frac{E \times v_i}{c} \times \frac{A_1}{A_1 + A_2}$$

where: $V_i$ is the velocity of the hammer at impact;
$A_1$ is the cross-sectional area of the hammer;
$A_2$ is the cross-sectional area of the shank;
E is Young's modulus;
c is the wave velocity in the hammer material; and
$\sigma$ is the stress amplitude.

The stress amplitude-time curve illustrated by the wave forms X′, X″ and X‴ in FIGS. 1A, 1B, and 1C is characteristic of a conventional hammer having a larger cross-sectional area ($A_1$) at a piston head than over the rest of the hammer body. The resulting wave forms are comprised of numerous transmission and reflection components. The sharp stress amplitude peaks P′, P″ and P‴ in the wave forms is the result of wave reflection at the large cross-section of the conventional hammer geometry. FIGS. 1A, 1B, and 1C further illustrate that, for a particular hammer velocity, the portions of the stress amplitude wave attributable to other cross-sectional areas of the hammer are at a minimum where the cross-sectional area of the hammer is at a minimum, i.e, over the length of an otherwise constant cross-sectional area hammer having a smaller cross-sectional area ($A_1$) than the piston head.

The amplitude of the reflected wave and the various losses due to rebound and friction are functions of the amplitude of the incident stress wave generated during impact and the stiffness response characteristics at the various interfaces in the apparatus. Reducing the amplitude of the incident wave attributable to different cross-sectional areas over the length of a hammer or a shank or other component of the drill string and optimizing stiffness response characteristics reduces these energy losses.

The area under the curves in FIGS. 1A, 1B, and 1C represents the incident impulse, and may be expressed as:

$$I = A \times \int \sigma dt$$

A equals the area of the drill string member at the point of measurement.

The total energy content of the stress wave is expressed as:

$$e = \frac{A \times c}{E} \int \sigma^2 dt$$

FIGS. 1A, 1B, and 1C also illustrate theoretical stress wave forms Y', Y'' and Y'''. Waves Y', Y'', and Y''' are more rectangular in shape than waves X', X'', and X''' and peaks in the stress amplitude have been minimized. The energy content of each wave Y may be the same as the energy content of each wave X. Conventional hammers typically produce most of the available energy in the first part of a wave form and produce a tail of relatively low stress amplitude over the remainder of the wave form. The relatively constant stress amplitude transfer of wave B is associated with hammer and drill components having constant cross-sectional areas over their length. It is possible to minimize reflected wave energy losses where it is possible to generate such a wave form by forming the hammer and drill components such that they are, individually, of constant cross-sectional area, and such that the cross-sectional areas of the hammer and the drill components are equal to one another.

Although wave forms Y produced by an apparatus including hammer and drill components of constant and equal cross-sectional area may have a lower peak stress amplitude than wave forms X produced with conventional pneumatic apparatus having sharp peaks P, the wave form Y may nevertheless contain the same amount of energy as, or more energy than the wave form X because energy transfer can occur over a longer period of time. Further, the energy content of each wave form, X and Y, is limited by the stress that the hammer or the drill string components can sustain. Therefore, an apparatus including hammer and drill components of constant and equal cross-sectional area in which the peak stress amplitude of the wave form Y is substantially equal to the maximum stress (plus a safety factor) that the hammer or drill string components can sustain, and for which energy transfer at the peak stress amplitude occurs over a somewhat extended period of time, can transfer more energy than a conventional pneumatic apparatus including hammer and drill string components for which the peak stress amplitude P of the wave form X is substantially equal to the maximum stress (plus a safety factor) that the conventional hammer and drill string components can sustain, and for which energy transfer at the peak stress amplitude is comparatively brief.

Hydraulic impact drilling devices are often designed to perform a drilling function using a hammer having the same cross-sectional area as that of a narrow shank, where the hammer has the same outside diameter as the shank. However, in hydraulic drilling devices, it is a relatively simple matter to minimize reflected energy losses, as hydraulic drilling devices enjoy the advantage of high pressure hydraulic fluid which can create large forces while acting on a surface of a narrow piston head.

Pneumatic impact drilling devices, by contrast, generally compensate for low working pressures by using large diameter piston heads. Pneumatic drilling devices generally utilize hammers with variable cross-sectional areas that do not enjoy the advantage of minimizing reflected stress waves. Consequently, reflected energy losses are typically significant in pneumatic devices.

OBJECTS AND SUMMARY OF THE INVENTION

It is, therefore, an object of the invention to provide a pneumatic rock drill apparatus which efficiently transmits energy to the drill bit.

It is another object of the present invention to provide a hammer for a drill apparatus which has a substantially constant cross-sectional area.

A further object of the invention is to provide a hammer for a pneumatic drilling apparatus which may be used with compressors typically in use in the field.

In accordance with a preferred embodiment of the present invention, a pneumatic impact drilling device includes a reciprocating hammer having a body portion and a piston head on the body portion. The piston head is preferably funnel shaped, but the body portion and the piston head have substantially the same cross-sectional area at all points along a longitudinal axis of the hammer. The housing of the device has a cylinder in which the hammer reciprocates. Air under pressure is directed to the cylinder to cause the hammer to reciprocate axially within the cylinder. A shank is mounted in the housing in position to be impacted by the hammer. A string of rods may be coupled to the shank in the housing. The cross-sectional area at all points along the longitudinal axis of each rod is substantially the same as the cross-sectional areas of the body portion and the piston head of the hammer. The hammer, the shank, and the rods each may be formed with an axial passage extending the length of the hammer, the shank, and the string. Air flows through the axial passage of the hammer and the axial passage of the shank and the rods to remove chips from a drill hole.

BRIEF DESCRIPTION OF THE DRAWINGS

A preferred embodiment of the present invention is described in more detail with reference to the accompanying drawings, in which like elements are identified by like reference numerals, and in which.

DETAILED DESCRIPTION

Figure 2:
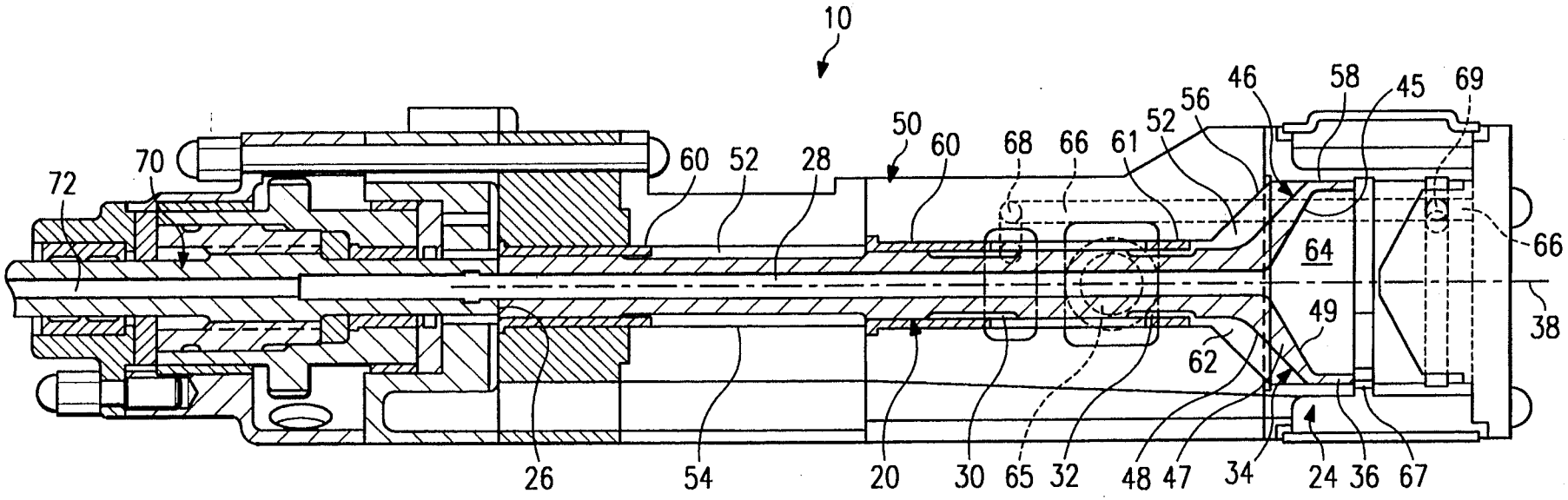
FIG. 2 is a longitudinal cross-sectional view of a pneumatic drilling apparatus in accordance with an embodiment of the present invention.

A pneumatic drilling apparatus 10, including an impact hammer 20, is shown in cross-section in FIG. 2. The apparatus 10 includes a housing 50 formed with a cylinder 52 for receiving the hammer 20. The hammer 20 is axially movable in the cylinder 52. A piston head 24 of the hammer 20 defines a lower chamber 62 and an upper chamber 64 of the cylinder 52.

Figure 4:
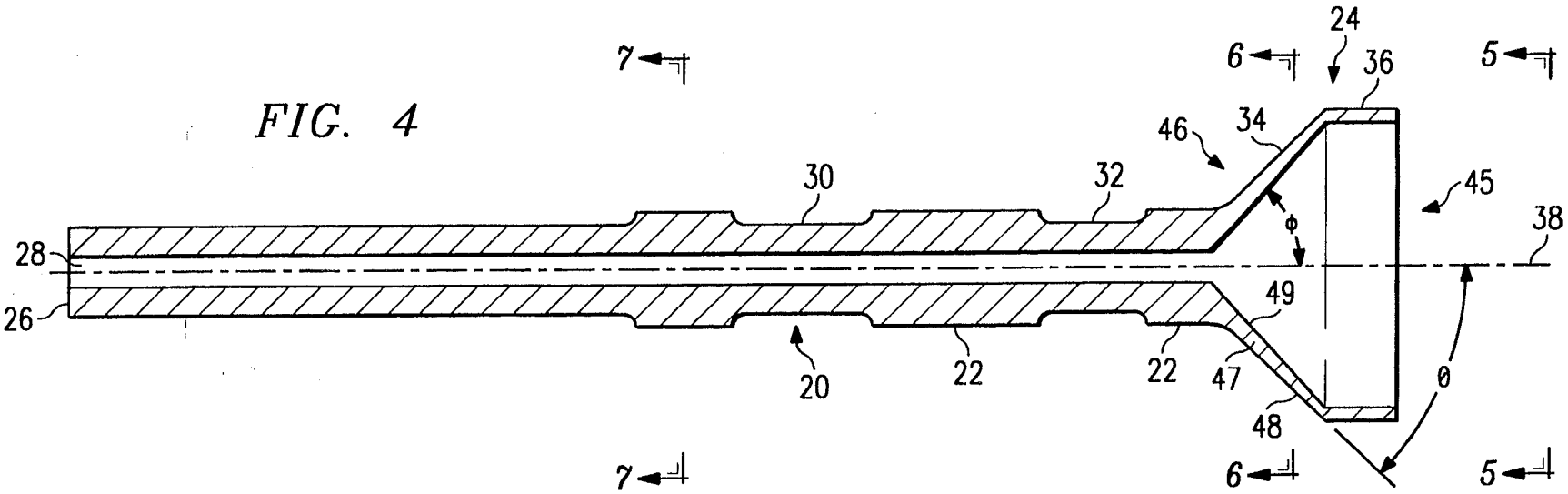
FIG. 4 is a longitudinal cross-sectional view of a pneumatic hammer in accordance with an embodiment of the present invention.

The hammer 20 is formed with an elongated and, preferably, generally cylindrical body portion 22 (FIG. 4). The piston head 24 of the hammer 20 preferably has a generally funnel-shaped portion 34 with a cylindrical lip portion 36 extending from a wide end of the funnel-shaped portion. The funnel-shaped portion 34 is preferably cone-shaped, having a wall 47 with substantially conical exterior and interior wall surfaces 48, 49. The lip portion 36 is concentric with the hammer axis 38.

The cylinder 52 is shaped to generally conform to the shape of the hammer 20. The cylinder 52 has a narrow forward section 54, a wide main section 58, and a transition section 56 between the narrow forward section and the larger main section. The transition section 56 forms an angle to the longitudinal axis of the cylinder 52 substantially equal to an angle $\Theta$ of the exterior wall 48 of the funnel-shaped portion 34 so that the exterior wall surface 48 of the funnel-shaped portion is near or adjacent to the transition section wall when the hammer 20 is in an impacting position (seen in FIG. 2).

Air from a compressor (not shown) is directed into and out of the cylinder 52 and against the top and bottom sides 45, 46 of the piston head 24 of the hammer 20 to reciprocate the hammer by a valve arrangement. Air enters the cylinder 52 through an inlet supply port 65 in the forward section 54 of the cylinder 52 and exits through an exhaust port 67 in the main section 58 of the cylinder. Recessed areas 30 and 32 are formed at predetermined positions along the body portion 22 of the hammer. Bearings 60, 61 are disposed concentrically on the narrow section 54 to provide sliding support for the body portion 22 of the hammer 20. The bearings 60, 61 cooperate with the recessed areas 30, 32 to direct pressurized air in the apparatus 10 to reciprocate the hammer 20. The lip 36 of the hammer 20 is moved, during reciprocation of the hammer 20, to alternating sides of the exhaust port, thereby permitting air to be exhausted from alternating sides of the piston head 24 as the hammer reciprocates.

During the beginning of an impact stroke of the hammer 20, the recessed area 32 is positioned relative to the bearing 61 such that communication between the inlet supply port 65 and the lower chamber 62 is substantially blocked, and little or no air pressure is directed against the bottom side 46 of the piston head 24. The lip 36 is located at a position in the main section 58 of the cylinder 52 above the exhaust port 67 so that air in the lower chamber 62 is exhausted. The recessed area 30 and the bearing 60 are positioned relative to one another such that the inlet supply port 65 communicates with the lower port 68 and the passage 66, which communicates, through the upper port 69, with the upper chamber 64. Pressurized air entering the apparatus 10 through the inlet supply port 65 is directed into the upper chamber 64 against the top side 45 of the piston head, thereby causing the hammer to move toward an impact position in which the impact face 26 of the hammer strikes the shank 70.

When the hammer 20 reaches the impact position, i.e., the position, shown in FIG. 2, in which the impact face 26 contacts the shank 70, the recessed areas 30 and the bearing 60 are positioned relative to one another such that there is no communication between the inlet supply port 65 and the lower port 68. The lip 36 is positioned below the exhaust port 67 so that the upper chamber 64 communicates with the exhaust port. The recessed area 32 and the bearing 61 are positioned relative to one another such that the inlet supply port 65 is in communication with the lower chamber 62. Pressurized air entering the apparatus 10 through the inlet supply port 65 is directed into the lower chamber 62 and against the bottom side 46 of the piston head 24 to commence a return stroke.

Figure 3:
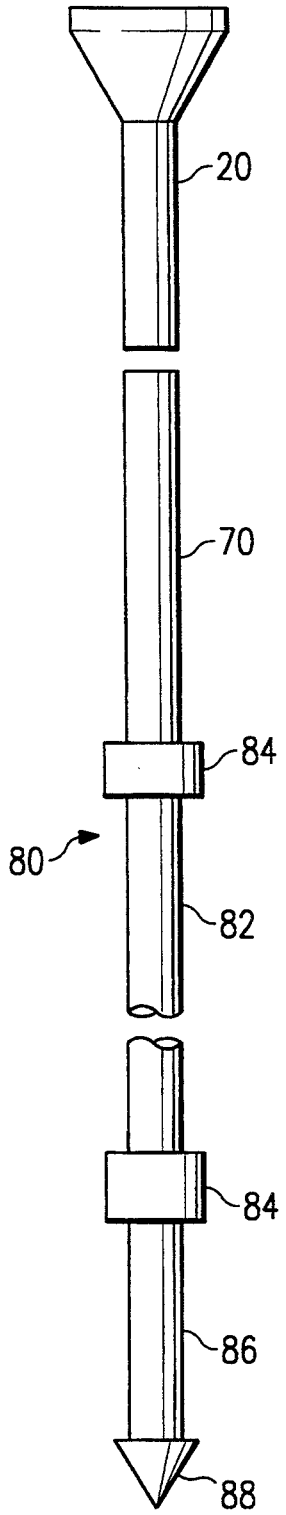
FIG. 3 is a schematic view of a hammer and drill string arrangement in accordance with an embodiment of the present invention.

The impact energy of the hammer 20 on the shank 70 is transmitted by the shank to a drill bit 88, shown schematically in FIG. 3, which strikes the rock being drilled. The hammer 20 shown in FIG. 3 is arranged to impact on the shank 70 in a drill string 80. The shank 70 is coupled to a drill rod 82 in the drill string 80 by a coupling 84. The drill string 80 is made as long as necessary for the particular drilling application, and one or more drill rods may be connected between rod 82 and terminal drill rod 86, which is connected to drill bit 88.

As seen in FIG. 4, the exterior wall 48 of the funnel-shaped portion 34 of the hammer 20 projects from the hammer body portion 22 at an angle 8, less than 90° from the longitudinal axis 38 of the hammer. The interior wall surface 49 of the funnel-shaped portion 34 is at an angle $\phi$ to the longitudinal axis 38 of the hammer 20 where $\phi$ is greater than $\phi$. The wall 47 of the funnel-shaped portion 34 decreases in thickness from the point where it meets the body portion 22 to the point where it meets the lip portion 36. The angles $\Theta$ and $\phi$ of the exterior and interior wall surfaces 48, 49 of the funnel-shaped portion 34 are preferably selected so that the amount of surface area created at the piston head, which translates air pressure into thrust of the hammer 20, is optimally balanced against the material thickness necessary to provide sufficient strength and rigidity of the funnel-shaped portion during reciprocation of the hammer 20. In a preferred embodiment, $\phi$ is equal to approximately 50°, $\Theta$ is equal to approximately 45° and the outside diameter of the piston head 24 is approximately 2.5 times as great at the widest portion of the funnel shaped portion 34 as at the body section 22.

Figure 1A:
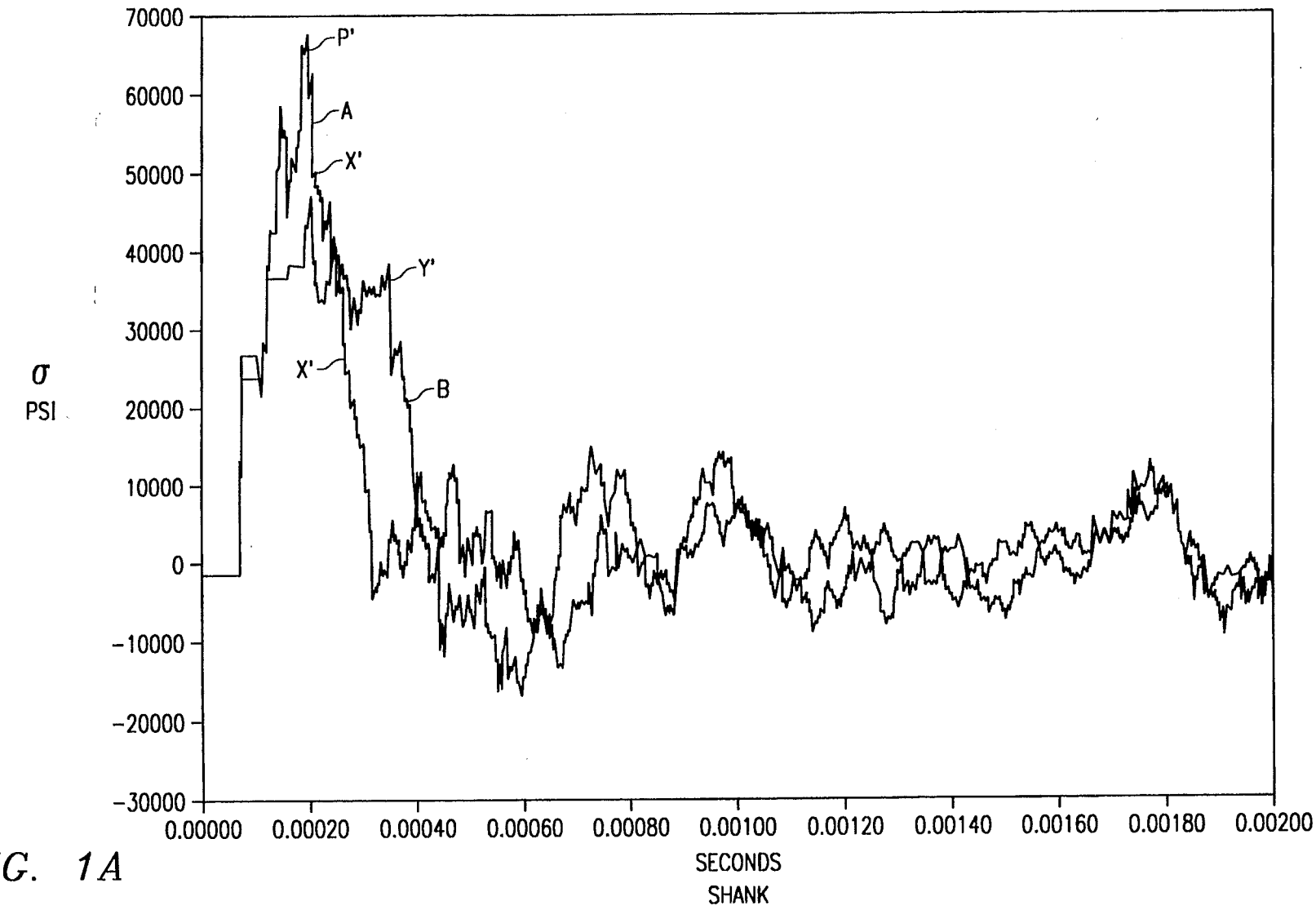
FIGS. 1A, 1B, and 1C are comparative theoretical modeled data graphically illustrating, at wave A, stress-time curves at various locations in a drill string in a conventional pneumatic hammer and drill apparatus and, at wave B, stress-time curves at the same locations in a drill string according to the present invention.
Figure 7:
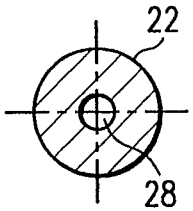
FIG. 7 is a cross-sectional view taken along lines 7–7 of FIG. 4.
Figure 6:
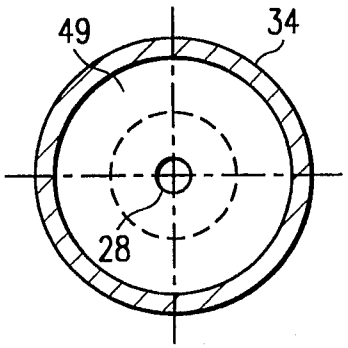
FIG. 6 is a cross-sectional view taken along lines 6–6 of FIG. 4.
Figure 5:
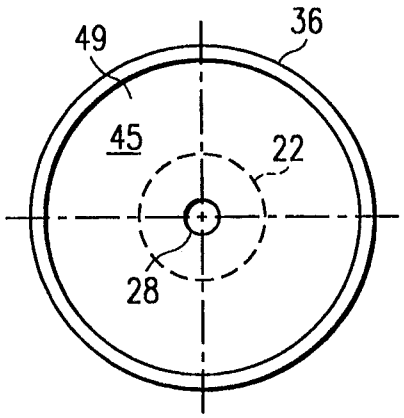
FIG. 5 is a cross-sectional view taken along lines 5–5 of FIG. 4.

As illustrated by FIGS. 5, 6, and 7, the cross-sectional area taken through any plane perpendicular to the axis 38 of the hammer 20 is substantially constant. Consequently, a substantially rectangular stress amplitude-time wave, preferably approximating the shape of the wave Y′ in FIG. 1A, is formed when the hammer 20 impacts the shank 70. Further, by forming the shank 70 of a material with the same impedance as the hammer 20 and constructing the shank with substantially the same cross-sectional area as the hammer, a reflected wave form in the hammer can be minimized, thereby facilitating efficient energy transfer. By steadily decreasing the thickness of the wall 47 of the funnel-shaped portion 34, it is possible to maintain a constant, or nearly constant, cross-sectional area as the diameter of the funnel-shaped portion increases. The surface area of the top side 45 of the piston head 24, as seen in FIG. 5, is sufficiently large to generate the forces necessary for rock drilling with available pressurized air. The inner and outer diameter of the body portion 22 and the inner and outer diameter of the lip portion 36 are also selected so that a constant cross-section area is achieved.

Figure 1B:
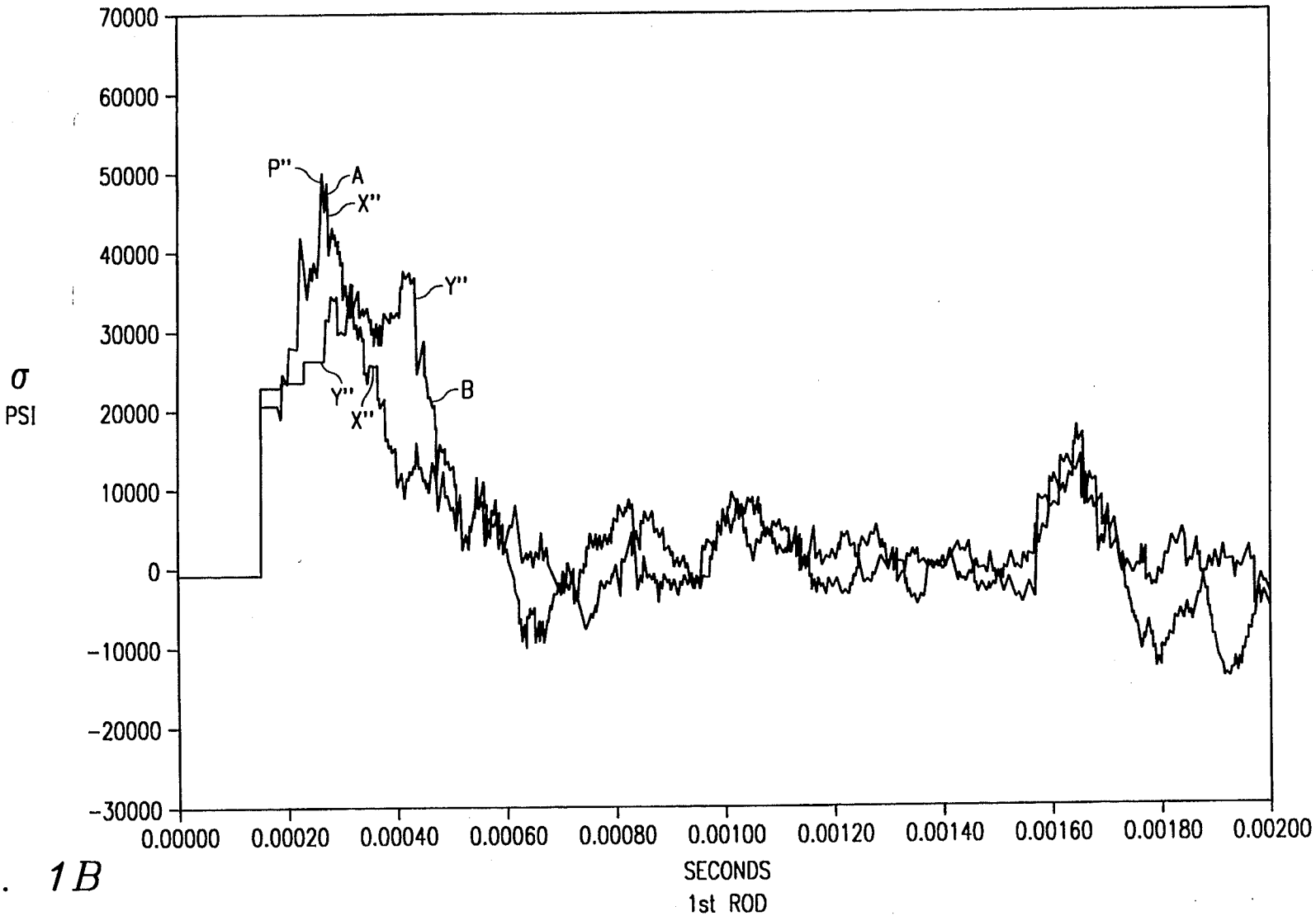
Figure 1C:
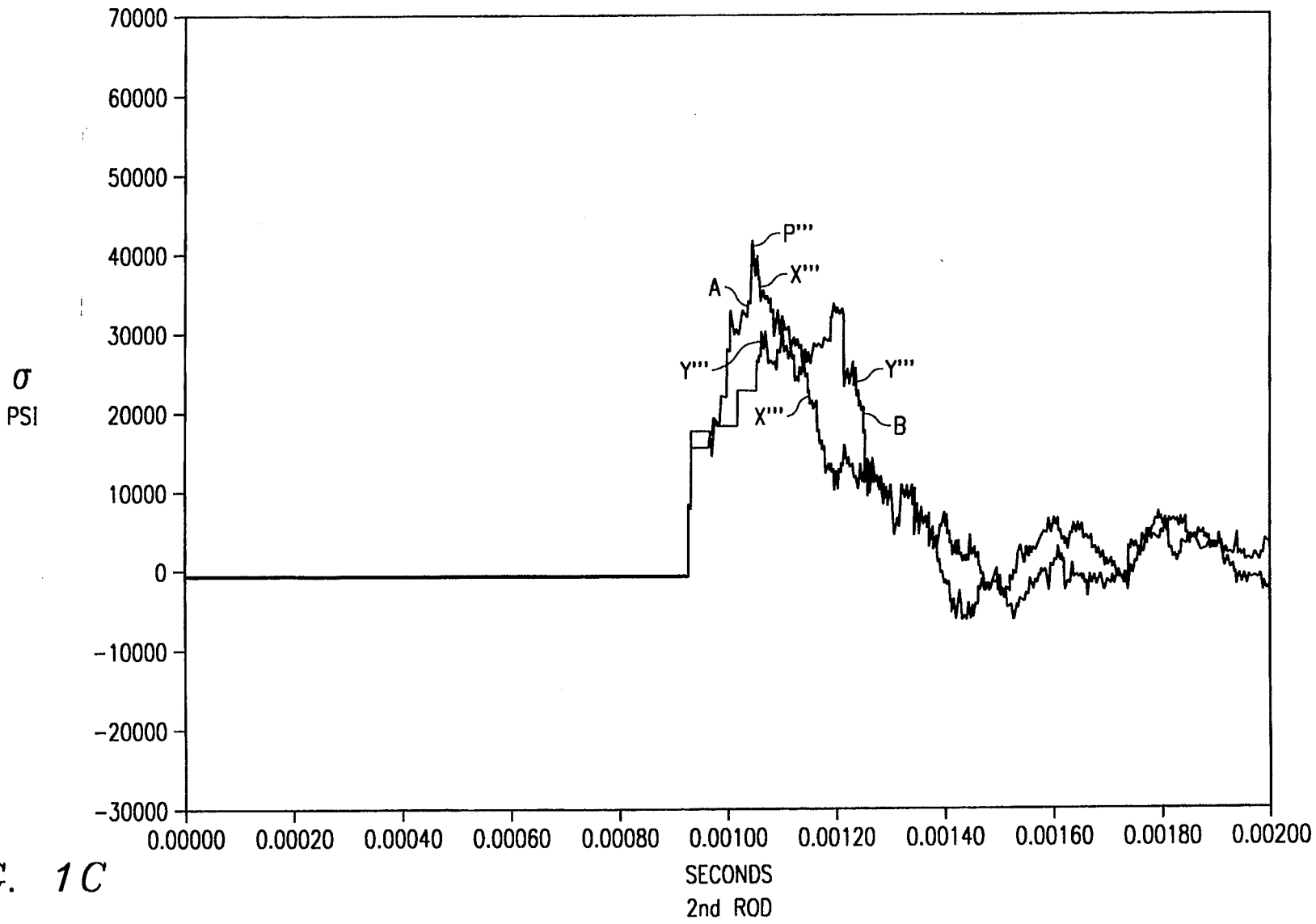

In a drill string 80 of the present invention, shown schematically in FIG. 3, each of the subsequent drill rods 82, 86 is selected to have a cross-sectional area substantially equal to the shank 70 and to the hammer 20. In this manner, a substantially rectangular stress amplitude-time wave, preferably approximating the shape of the waves Y″ and Y‴ shown in FIGS. 1B and 1C, is formed when the hammer 20 strikes the shank 70, the shank strikes the drill rod 82, and so forth, thereby enhancing efficient energy transfer from the hammer and down the drill string 80 to the drill bit 88.

In the apparatus 10 shown in FIG. 2, a continuous central passage such as a bore 28, open at both ends of the hammer 20, is formed to allow air to flow through the hammer from the piston head 24 to the impact face 26. The shank 70 is disposed in the housing 50 at an end of the cylinder 52 and extends partly into the cylinder. The shank 70 has a continuous central passage such as a bore 72 which communicates with the central bore 28 of the hammer 20. Air which flows through the hammer bore 28 via a blow tube flows through the bore 72. In this manner, air is conducted to the drill bit 88, shown in FIG. 3, during drilling to flush rock fragments and debris from the hole being drilled. Removing debris from the hole helps maintain drill bit contact with the rock for more effective drilling. It is preferred to form the hammer 20 with the central bore 28, regardless of whether the shank 70 is formed with a bore 72, because the central bore can nonetheless facilitate air-oil seepage lubrication of the components of the apparatus near the shank. Often, for instance, it is preferred to introduce air for flushing rock fragments at a point (not shown) in the shank somewhat distant from the point at which the shank is impacted by the impacting face 26 of the hammer 20.

In operation, the hammer 20 is driven to impact the shank 70 when a compressor (not shown) supplies compressed air through the inlet supply port 65, the air passes through the lower port 68, through the passage 66, through the upper port 69, and then into the upper chamber 64 and against the upper side 45 of the piston head 24 so that the hammer 20 is forced through an impact stroke. During at least a portion of the impact stroke, air is exhausted from the lower chamber 62 through the exhaust port 67. Movement of the hammer 20 from right to left in the apparatus 10 shown in FIG. 2 occurs during the impact stroke. The hammer 20 is shown, in FIG. 2, in the impact position in contact with the shank 70. Compressed air is then supplied through the inlet supply port 65 and to the lower chamber 62 and against the lower side 46 of the piston head, to force the hammer through a return stroke. During at least a portion of the return stroke, air is exhausted from the upper chamber 64 through the exhaust port 62.

The diameter of the shank 70 is selected so that its cross-sectional area is substantially equal to the cross-sectional area of the hammer 20. This pairing of the hammer 20 and shank 70 of substantially equal cross-sectional area, as mentioned above, minimizes the peak stress amplitude and the reflected wave component. Also, transmitted stress waves of such components will be substantially rectangular, thereby further facilitating efficient energy transfer. The substantially rectangular stress waves in the shank 70 and the drill rods 82 and 86 will preferably approximate the shape of the waves Y′, Y″, and Y‴ shown in FIGS. 1A, 1B, and 1C, respectively. Further still, the cross-sectional area of the hammer 20, the shank 70, and the drill rods 82, 86 may be selected so that the peak stress amplitude in these components is substantially equal to the maximum stress that these components can sustain, plus a desired safety factor, thereby facilitating maximum energy transfer to the rock.

While this invention has been illustrated and described in accordance with a preferred embodiment, it is recognized that variations and changes may be made therein without departing from the invention as set forth in the claims.

What is claimed is:

1. A pneumatic impact drilling apparatus, comprising:

a hammer having an elongated, cylindrical body, the body having first and second ends and a major portion thereof having a predetermined cross-sectional area, a piston head having a funnel-shaped portion and a lip portion extending from a wide end of the funnel-shaped portion, the body portion, the funnel shaped portion, and the lip portion having substantially the same predetermined cross-sectional area such that during an impact stroke of the impact device, a substantially rectangular impact generated stress wave is thereby produced to reduce peak stress levels on the hammer and facilitate increased hammer impact velocity, an axial passage extending the length of the hammer through the body portion, the funnel-shaped portion, and the lip portion, an exterior face of the funnel-shaped portion forming an angle of 50° to the longitudinal axis of the hammer, an interior face of the funnel-shaped portion forming an angle of 45° to the longitudinal axis of the hammer, and the exterior face and the interior face of the funnel-shaped portions forming at least portions of a lower and an upper side of the piston head, respectively;

a housing formed with a cylinder for receiving the hammer, the hammer being axially movable in the cylinder, the wide portion of the funnel-shaped portion and the lip portion defining a lower chamber and an upper chamber of the cylinder;

valving means for alternately directing compressed fluid to the lower and upper chamber of the cylinder to act alternately against the lower and upper sides of the piston head for moving the hammer through a return and an impact stroke, respectively; and a shank, mounted in the housing in position to be impacted by the hammer when the hammer is moved through the impact stroke, the shank having an axial passage extending the length of the shank, the shank having substantially the same cross-sectional area as the cross-sectional area of the major portion of the body;

wherein fluid flows through the axial passage of the hammer and the axial passage of the shank during the impacting stroke of the cylinder.

2. The impact drilling apparatus of claim 1, wherein fluid flows through the axial passage of the hammer and the axial passage of the shank during the return stroke of the cylinder.

3. A hammer for a pneumatically driven impact device, comprising:

an elongated body having first and second ends and a major portion thereof having a predetermined cross-sectional area; and a piston head adjacent the second end of the body, the piston head having a larger outer periphery than the body and having substantially the same predetermined cross-sectional area cross-sectional area of the major portion of the body that during an impact stroke of the impact device, a substantially rectangular impact-generated stress wave is thereby produced to reduce peak stress levels on the hammer and facilitate increased hammer impact velocity.

4. The hammer of claim 3, wherein the body portion is cylindrical.

5. The hammer of claim 3, wherein the piston head is disposed at one end of the body portion and is funnel-shaped.

6. The hammer of claim 5, further comprising a cylindrical lip portion extending from a wide end of the piston head, the cross-sectional area at all points along a longitudinal axis of the lip portion being substantially the same as the cross-sectional areas of the body portion and the piston head.

7. The hammer of claim 5, wherein an interior surface of the piston head is cone-shaped.

8. The hammer of claim 5, wherein an exterior surface of the piston head is at an angle relative to the longitudinal axis of the hammer.

9. The hammer of claim 8, wherein the exterior surface of the piston head is angled at forty-five degrees relative to the longitudinal axis of the hammer.

10. The hammer of claim 3, wherein a wall portion of the piston head decreases in thickness as an outside diameter of the piston head increases.

11. The hammer of claim 3, wherein an axial passage extends through the body portion and the piston head.

12. The hammer of claim 11, wherein at least a portion of the axial passage is a continuous axial bore.

13. The hammer of claim 3, wherein an outside diameter of the piston head is greater than 2.5 times an outside diameter of the body portion.

14. A pneumatic impact drilling device, comprising:

a hammer including a body having first and second ends and a major portion thereof having a predetermined cross-sectional area and a piston head positioned adjacent to the second end of the body, the piston head having a larger outside periphery than the body and having substantially the same predetermined cross-sectional area as the cross-sectional area of the major portion of the body such that during an impact stroke of the impact device, a substantially rectangular impact-generated stress wave is thereby produced to reduce peak stress levels on the hammer and facilitate increased hammer impact velocity;

a housing formed with a cylinder for receiving the hammer, the hammer being axially movable in the cylinder;

means for directing fluid to the cylinder to cause the hammer to reciprocate axially within the cylinder;

means for transmitting energy from the hammer, the transmitting means being impacted by the hammer.

15. The impact drilling apparatus of claim 14, wherein the transmitting means includes a shank.

16. The impact drilling apparatus of claim 15, wherein the cross-sectional area at all points along a longitudinal axis of the shank is substantially the same as the cross-sectional areas of the body portion and the piston head.

17. The impact drilling apparatus of claim 16, wherein the transmitting means further includes a string of coupled drill rods, the cross-sectional area at all points along a longitudinal axis of each drill rod being substantially the same as the cross-sectional areas of the body portion and the piston head.

18. The impact drilling apparatus of claim 14, wherein an axial passage extends through the body portion, the piston head, and the transmitting means.

* * * * *